United States Patent [19]

Beucus et al.

[11] Patent Number: 4,472,850

[45] Date of Patent: Sep. 25, 1984

[54] METHOD AND APPARATUS FOR CONDENSING AND CONTINUOUSLY TREATING STAPLE LENGTH FIBROUS MATERIALS

[75] Inventors: A. John Beucus; Julian B. Wilson, Jr.; Anthony W. Nusz, all of Morganton, N.C.

[73] Assignee: Beu-Tex Corporation, Morganton, N.C.

[21] Appl. No.: 390,202

[22] Filed: Jun. 21, 1982

[51] Int. Cl.[3] ..... D06B 3/02; D06B 23/00

[52] U.S. Cl. ..... 8/149.1; 8/156; 68/5 D; 68/13 R; 68/22 R

[58] Field of Search ..... 68/44, 45, 158, 15, 68/22 R, 5 D, 5 E, 13 R, 45; 8/156, 149.1

[56] References Cited

U.S. PATENT DOCUMENTS

| | | | |
|---|---|---|---|
| 2,513,344 | 7/1950 | McEwen | 8/156 |
| 2,803,125 | 8/1957 | Mesek | 8/156 |
| 3,038,777 | 6/1962 | Daul et al. | 8/156 |
| 3,314,256 | 4/1967 | Walsh et al. | 68/45 |
| 3,529,446 | 9/1970 | Fleissner | 68/22 R |
| 4,104,019 | 8/1978 | Smith | 8/2 |

FOREIGN PATENT DOCUMENTS

| | | | |
|---|---|---|---|
| 2052581 | 1/1981 | United Kingdom | 68/13 R |

*Primary Examiner*—Philip R. Coe
*Attorney, Agent, or Firm*—Luke J. Wilburn, Jr.; Wellington M. Manning, Jr.

[57] ABSTRACT

Method and apparatus for continuously treating staple length fibrous materials by applying a liquid dye or other chemical to the fibrous materials, conveying the liquid impregnated materials into and through an elongate heating tube under compression to react or fix the dye or chemical in the fibers, and collecting the fibers; and wherein the continuously moving loose fibers are condensed into a fibrous web before passage through the liquid dye or chemical applicator to provide sufficient cohesive integrity to the web so that it can be passed into and through the liquid dye or chemical, and the driven nip rollers of the dye applicator without parting.

6 Claims, 2 Drawing Figures

METHOD AND APPARATUS FOR CONDENSING AND CONTINUOUSLY TREATING STAPLE LENGTH FIBROUS MATERIALS

This invention relates to method and apparatus for treating continuously moving staple length textile fibrous materials, and, more particularly, to an improved method and apparatus for applying a liquid dye or other chemical to continuously moving staple fibers followed by application of high frequency energy to fix or react the dye or chemical with the fibrous materials, and wherein the moving loose staple fibers are formulated into a cohesive web to facilitate dye chemical application. As used herein, the terms "liquid dye or other chemical" means any dye or other chemical which is in a liquid medium form when applied to the textile fibrous materials.

BACKGROUND OF THE INVENTION

U.S. Pat. No. 4,104,019 discloses apparatus and method for fixation of dyes and other chemicals in textile fibers, however formed or combined, wherein the textile fibrous materials are wetted with dye or other chemicals and are continously mechanically conveyed through a closely confined tube located between electrodes which create a radio frequency (RF) energy field in the tube. The fibrous material is packed within the tube during its passage therethrough so as to provide a partially self-sealing pressure chamber therein due to generation of steam whereby the rate of reaction of the dye or chemical on the fibers is accelerated.

As shown in FIG. 3 of the patent, loose fibrous materials are continuously conveyed by suitable conveyors to a liquid dye or chemical applicator unit. The fibers are gravitationally delivered by a chute into a padding unit which contains a moving belt having an amount, or level, of liquid dye or chemical thereon. The liquid dye or chemical transfers into the fibrous material as it is fed into the nip portion of a double roller mangle comprising an upper drum and a lower drum over which the belt passes. The pressure of the roller mangle is controlled to express excess dye or chemical from the wetted fibers and obtain a desired wet pick-up, after which the fibers are further continuously directed into an elongate RF energy heating tube where they are compacted during heat fixation.

It is also known in such equipment as described in U.S. Pat. No. 4,104,019 to utilize a fiber-receiving hopper for receiving the wetted fibrous material from the padding unit and delivering the same under compression into the RF heating tube. The hopper has an open top for gravitationally receiving the wetted fibrous material in a continous stream, or flow, into a lower fiber compression chamber which communicates with the RF energy heating tube. A fluid-actuated ram cycles through the hopper compression chamber to compress and pack the fibrous material into and push it through the heating tube. The compressed fibrous material moving through the tube is heated by RF energy to react or fix the dye or chemical on the fibers, and the material leaves the heating tube against the action of a reduced back pressure piston, after which it is washed, dried and collected in suitable manner.

The apparatus and process above described provides the advantages of a continuous dyeing operation utilizing less energy consumption than the conventional discontinous batch dyeing operations heretofore employed in the prior art. Such apparatus and process also permits effective uniform dyeing of loose fibrous materials with lesser amounts of dye liquid than the prior art batch dyeing operations. Typically, fibrous materials in loose form can be uniformly and effectively dyed utilizing a wet pick-up of dye composition of as low as 100% by weight on the textile fibers.

As aforementioned, it has been a practice to continuously introduce the loose staple fibers to the liquid dye applicator unit by means of an inclined chute which gravitationally delivers the fibers into contact with the viscous liquid dye composition on the moving belt of the dye applicator, after which the fibers pass through the nip of the double roller mangle. This action impregnates the fibers with dye and expresses excess dye from the fibers to obtain the desired dye pick up thereon. In such operations, problems occur in maintaining a continuous and uniform flow of the loose fibers through the dye applicator unit, particularly into and through the viscous liquid dye and the nip of the roller mangle. Discontinuities in the feed of the loose fibers in their longitudinal direction of movement occur and cause a build up of the gravitationally urged fibers at the dye unit which precludes their passage through the mangle rollers. Such discontinuity of feed and build up of fibers necessitates interruption of the continuous dyeing operation to correct the situation, with corresponding loss of efficiency of the operation.

BRIEF OBJECTS OF THE INVENTION

It is therefore an object of the present invention to provide improved apparatus and method for the high speed, continuous treatment of textile staple length fibrous materials of the type described which permits more effective and accurate application of desired amounts of liquid dye or other chemical to the moving materials.

It is a more specific object to provide improved apparatus and method for dyeing or otherwise chemically treating continuously moving textile staple fibers wherein the fibers are formed during their continuous conveyance into a web having sufficient cohesive integrity to effectively pass in unbroken web form through the dye or chemical applicator unit for impregnation, while being readily separated into multiple smaller discrete fiber masses for subsequent compression and heat processing under compression to fix or react the dye or chemical on the fibers.

SUMMARY OF THE INVENTION

The invention comprises an improvement in method and apparatus for the continuous treatment of textile staple length fibrous materials, wherein the loose fibers are combined in a generally cohesive web for introduction into and passage through a dye or other chemical applicator unit to apply accurate amounts of liquid dye or chemical thereto. The impregnated fibers leaving the padding unit are separated into discrete smaller portions of fiber mass which can be effectively forced under compression through a continuous elongate high frequency energy heating tube for fixation of the dye or chemical therein.

More specifically, loose staple length fibers are continuously pneumatically conveyed into a fiber condenser unit comprising a rotating, perforous drum on which the fibers impinge. Pressure differential between the interior and exterior of the drum draws the staple fibers into a randomly oriented cohesive web thereon during drum rotation. The fibrous web, which is composed of generally randomly oriented fibers of staple length, are removed from the drum of the condenser unit and pass by gravity conveyance into contact with the viscous liquid dye and thereafter through the nip of the roller mangle of the dye or chemical applicator unit. The cohesion of the web is such that it maintains its longitudinal integrity as it passes continuously through the dye and nip roller section, while being readily mechanically separated into smaller discrete staple fiber masses or portions for introduction into the compression and high frequency energy heating sections of the treating range.

BRIEF DESCRIPTION OF THE DRAWINGS

The above as well as other objects of the present invention will become more apparent, and the invention will be better understood from the following detailed description of a preferred embodiment thereof, when taken together with the accompanying drawings, in which.

DETAILED DESCRIPTION OF THE PREFERRED EMBODIMENTS OF THE INVENTION

Figure 1:
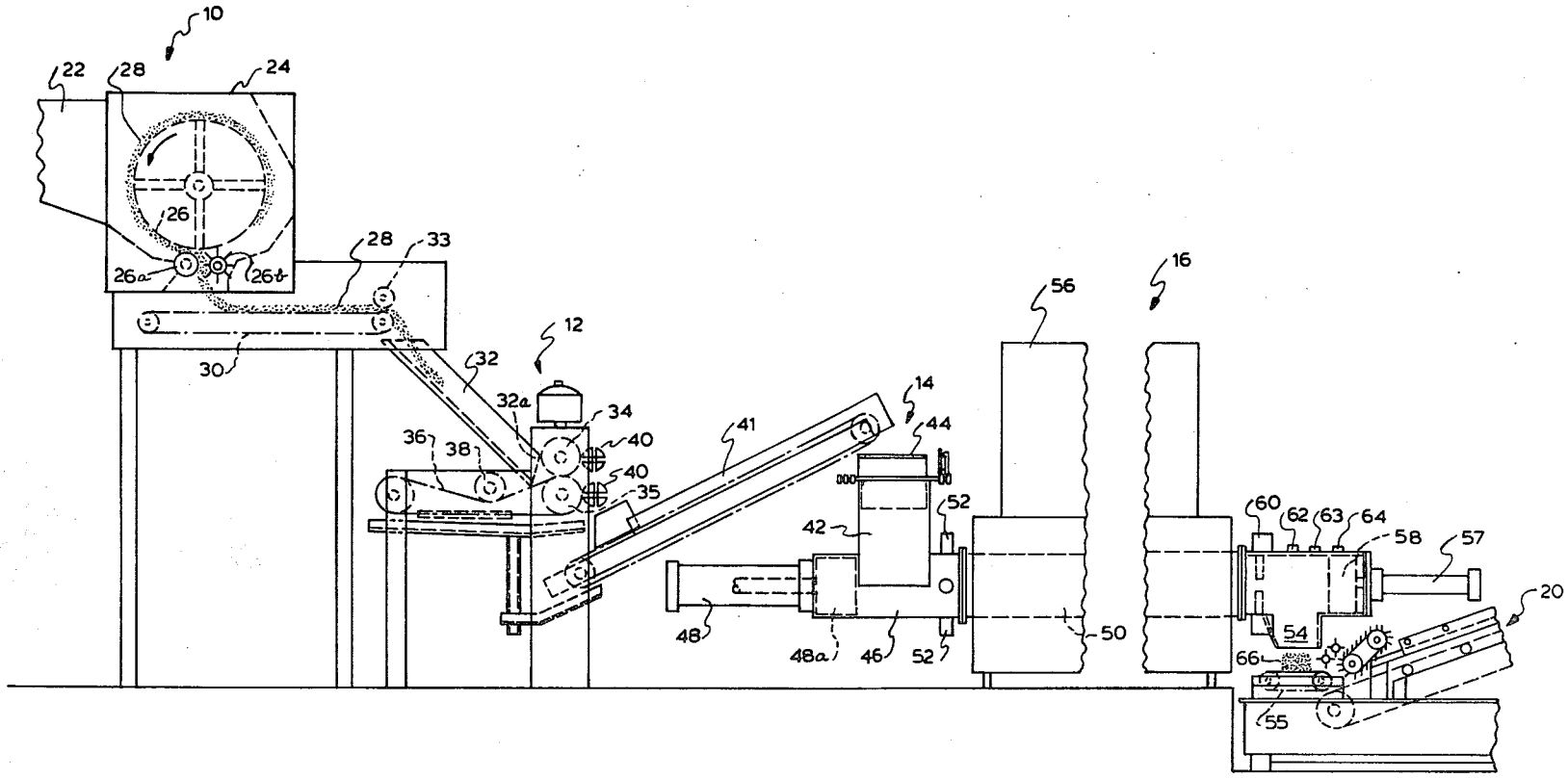
FIG. 1 is a schematic side elevation view of apparatus for the treatment of continuously moving textile fibrous material by the application of liquid dyes thereto, with subsequent heat fixation of the same thereon by passage under compression through a confined high frequency energy heating tube.

Referring more specifically to the drawings, FIG. 1 shows improved apparatus of the present invention for the continous dyeing or otherwise chemically treating of continuously moving textile fibrous material. Basically, the continuous treatment range includes a textile fibrous material supply and condensing section 10, a dye or chemical applicator section 12, a fibrous material compression section 14, a high frequency energy heating tube section 16, and a washing section 20.

Figure 2:
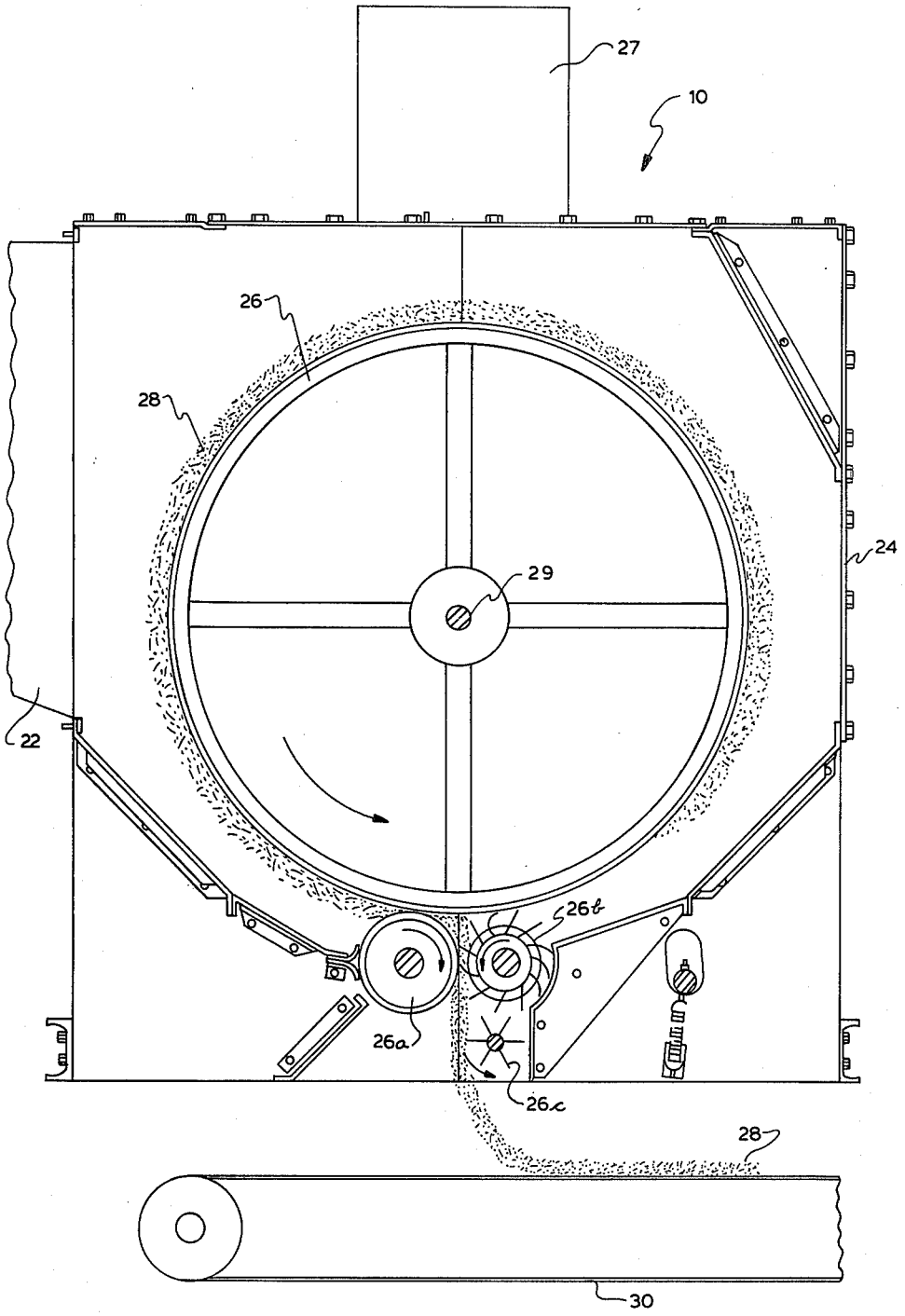
FIG. 2 is an enlarged schematic side elevation view of the fiber condenser unit of the apparatus of FIG. 1, with side cover of the housing of the unit removed to better show the manner in which staple length fibrous materials are collected and formed into a cohesive web for subsequent delivery into the dye applicator unit of the apparatus.

Textile fibrous material, typically in the form of loose staple length fibers, is pneumatically conveyed by way of a delivery tube 22 from a suitable supply source, such as conventional textile opening and weigh pan blending equipment (not shown), into a fiber condenser unit 24 containing a rotating filter drum 26. The surface of the drum is perforous and the interior of the drum is suitably connected by way of conduit through a side wall of the unit to a vacuum source, such as a motorized fan in a housing 27 (FIG. 2) which draws the fibers into the unit 24 to form a condensed fibrous batt or web 28 on the filter drum outer surface. The drum is mounted on a support shaft 29 suitably connected to a drive motor (not shown) and is continuously rotated in the direction indicated by the arrow to convey the web of randomly oriented fibers under a pressure roller **26*a* for removal from the drum surface by a flexible bladed doffing roller 26*b* and wiping roller 26*c*. The web 28 which has longitudinal cohesive integrity is deposited onto a moving belt conveyor 30 which continuously delivers the web to an inclined chute conveyor 32. The fiber web 28 leaving the end of belt conveyor 30 is compressed by passage beneath a weighted driven roller 33. The condenser unit 24, which is shown in more detail in FIG. 2**, is of a type air filter unit manufactured by Continental Conveyor and Equipment Co. of Sherman, Tex. the trademark "Fibr-A-Filter II". Details of construction of such units are known in the textile industry. Typically such equipment has heretofore been employed to remove contaminants from the air in processing areas of textile manufacturing plants.

The lower outlet end **32*a* of chute 32 is disposed immediately adjacent the nip of a pair of mangle rollers 34, 35 of a liquid dye or chemical padding unit which comprises the liquid dye or chemical applicator section 12. The amount of fiber supplied to the treating apparatus and thus the padding unit is controlled by varying the rate of supply of loose fiber to condenser unit 14**, and suitable motor means, e.g., DC drive motors, (not shown) are operatively connected in conventional manner to positively drive the various conveyors and rollers for delivery of fibers through the treating apparatus.

The padding unit of section 12, details of which are known in the art, includes a driven endless belt 36, the central portion of the upper reach of which is downwardly deflected by rollers 38 to form a depression, or well, for retaining the treating liquid, such as a liquid dye composition. Belt 36 is entrained about the lower mangle roller 35 and moves to convey and transfer liquid dye into the fiber web as it is delivered from the end of chute 32 into the nip of the mangle rollers. Pressure is applied in conventional manner to the mangle rollers to express liquid dye from the fibers and obtain a desired amount of wet dye pickup in the fibers. The dye-impregnated fibers are removed from the surface of the mangle rollers by rubber-bladed scraper rollers 40 and are deposited in broken apart, smaller masses of fibers onto a continuously moving conveyor 41.

The wetted loose fibrous material containing a desired amount of dye liquid is continuously gravitationally delivered by conveyor 41 into the upper end of a fiber-receiving hopper 42 to fiber compression section 16. As seen in FIG. 1, hopper 42 is disposed beneath the upper end of conveyor 41 and has a generally rectangular upper opening communicating with lower fiber compression chamber 46. The compression head **48*a* of a double-acting hydraulic ram assembly 48 moves through the compression chamber in a generally horizontal direction to compress the fibrous material received in the chamber and push the same into an elongate confined radio-frequency energy heating tube 50. A plurality of hydraulic piston-actuated, fiber-retaining pins 52 are arcuately disposed about the inlet of heating tube 50 and are arranged and operated to move radially into the fiber passageway to retain compressed fiber in the heating tube 50 against backward movement into the compression chamber 46 each time ram head 48*a*** is retracted for the beginning of another compression stroke.

Located in the upper opening of hopper 42 are a pair of fiber-collecting plates 44 which are pivotally mounted on opposed side walls of the hopper to be pivotally moved in response to ram head position by pneumatic piston means (not shown) from an overlapping position to collect fibers falling into the hopper from conveyor 41, to a downwardly extending position to periodically discharge the collected fibers into compression chamber 46 when ram head **48*a* is retracted therefrom. Details of the construction and operation of the collecting plates 44** in conjunction with ram head movement form the subject matter of a copending commonly assigned Beucus U.S. Pat. application Ser. No. 06/390,207, filed concurrently herewith. The disclosure of such application is incorporated herein by reference.

The compressed fibers passing through tube 50 are heated by conventional RF energy generating equipment, which includes an H.T. transformer, rectifier, tube oscillator, and tank circuit adjustable to give a radio frequency of 27.12 megahertz. The generating equipment, details of which are known in the art and are not shown in FIG. 1, are located in an insulated protective housing 56. The RF energy imparted to the dye-impregnated, compacted fibers in tube 50 raises the temperature in the fibrous material to a desired degree to set and/or otherwise fix the dye on the fibers, as by ionic bonding of the dye molecules to the fiber molecules.

As best seen in FIG. 1, the exit end of the heating tube 50 has a downwardly disposed fiber outlet 54 for discharging fibers onto a moving conveyor 55. Disposed in the exit end portion of heating tube 50 to control periodic discharge of compressed fiber mass sections from the tube is a pneumatic piston 57 with pressure head 58 and a plurality of pneumatic piston-actuated, fiber-retaining pins 60. Pistons of the pressure head 58 and retaining pins 60 are of the double-acting type and connected through conventional control valves, pressure regulator, and supply lines to a source of pressurized air (not shown). The exit piston pressure head 58 is arranged to move horizontally through the end portion of the heating tube over outlet 54, and located in its path of travel are three switches 62, 63, 64 which are connected to actuate the pneumatic control valves and supply pressurized air to the exit piston and pin pistons in the following sequence.

Compressed fiber mass sections 66 are periodically discharged from the heating tube in the following cycle. When the exit piston pressure head 58 is fully extended into the exit end of the heating tube to close the tube passageway and contact switch 62, pressure regulated air is supplied to the exit piston 57 to maintain a constant counter pressure of the pressure head against the compressed fibers in the tube. Pressurized air is also supplied to the pistons of pins 60 to fully retract the pins from the heating tube passageway. As fiber pressure builds in the heating tube due to the compressing action of the main compression ram assembly 48, the exit piston pressure head 58 is pushed outwardly of the tube by the moving fiber mass, to the right as seen in FIG. 1, until it contacts switch 63. Switch 63 actuates the air control valves to supply pressurized air to the pistons of pins 60 to insert the pins into the heating tube passageway and thereby retain the fibers under compression in the tube upstream of the pin positions. Pressurized air is also supplied to the exit piston 57, after momentary time delay, to move the pressure head 58 quickly further outwardly of the exit end of the heating tube, thereby releasing the section of compacted fibers between the pins and pressure head which falls by gravity through the heating tube outlet 54 and onto the conveyor 55. When the pressure head 58 contacts switch 64, pressurized air is supplied to the exit piston 57 to return the pressure head back to its innermost position to contact switch 62 and close the tube outlet 54. Contact of the pressure head with switch 62 directs compressed air to again retract the fiber-retaining pins 60 from the heating tube passageway and establish a constant counter pressure of the pressure head 58 on the fibers for the beginning of another discharge cycle.

Sections 66 of released fibrous material which gravitationally fall from exit outlet 54 of the tube are conveyed by suitable conveyor sections through washing section 20, after which they are dried and collected in suitable manner (not shown).

As mentioned above, before the incorporation of the fiber condenser unit into the treating apparatus, loose staple length fibrous materials gravitationally delivered to the dye or chemical applicator unit 12 could not be effectively continuously fed through the nip portion of the mangle rollers 34, 35, necessitating shut down of the fiber supply to correct the situation and consequent loss in efficiency of operation of the equipment. In addition, an interrupted delivery of the loose staple fibers to the nip rollers made it more difficult to control the uniformity of dye application and fixation on the fibers. By utilization of a fiber filter unit heretofore employed for air filtration to provide a generally cohesive web of fibers in direction of longitudinal movement of the same, the loose fibrous materials can be continuously fed at a generally uniform rate through the dye applicator unit without consequent build up of fibers at the applicator unit and loss of operating time of the equipment.

The cohesive batt or web of fibers must have sufficient cohesion to maintain its longitudinal integrity during passage through the viscous liquid dye composition on the moving belt 36 and subsequently through the mangle rollers 34, 35 of the dye applicator unit, while permitting the ready break up of the web into smaller fiber portions by bladed scraper rollers 40 before introduction of the dye-wetted fibers into the hopper unit compression chamber 46 for compaction into heating tube 50.

The condenser unit disposes the staple length fibers in a random orientation in the web formed on the filter drum surface. The degree of cohesion of the web may be varied to some degree by the density and thickness of the web per unit surface area thereof. Typically, the web is given a cohesive integrity such that a 24 inch hanging vertical length of the web will support its own weight without separation.

The present invention may be better illustrated by the following specific example of the conditions of operation of the apparatus described and shown herein, and utilizing the fiber condenser unit of the present invention to form the staple fibers into a 56 inch wide continuous length cohesive web prior to their introduction into the dye padding unit.

EXAMPLE

Loose 1⅛ inch staple length acrylic fibers are continuously pneumatically conveyed into the fiber condenser unit 24 at a rate of 700 pounds per hour, from fiber opening and weigh pan blending equipment. Suction from the fan 27 of the condenser unit draws the loose fibers onto the surface of the rotating filter drum 26 where they deposit themselves in a randomly oriented fashion to form a fibrous web. The filter drum is rotated at 4 revolutions per minute to deliver a cohesive web of fibers onto horizontal conveyor 30 at a linear delivery rate of 25 feet per minute and with a web thickness of about 2 inches. Conveyor 30 is operated at a linear speed of 33 feet per minute to deliver the web beneath weighted roller 33 and onto the gravity delivery chute 32 of the dye applicator unit 12. The web has sufficient cohesion to pass into contact with the viscous liquid dye composition in the unit and through the nip of the mangle rollers 34, 35 without parting. The mangle rollers of the pad are operated at a linear delivery rate of 35 feet per minute. The fibrous web leaving the exit side of the nip portion of the mangle rollers is contacted by bladed scraper rollers 40 which break the web apart into discrete smaller fiber sections for delivery onto inclined conveyor 41. The fibers are continuously delivered into the fiber hopper 42 where they are compressed by the compression ram 48 into and through the RF energy heating tube 50. The compressed and compacted fibers are heated in the heating tube to react and fix the dye therewith. Compressed fiber sections are periodically discharged from the exit end of the heating tube onto horizontal conveyor 55. The fibers are conveyed through washing section 20 where they are continuously washed, and therefore dryed and collected.

That which is claimed is:

1. In apparatus for the treatment of continously moving textile fibrous materials, including a liquid dye or chemical applicator having driven nip roller means carrying liquid dye or other chemical theron for impregnating into and expressing the liquid from textile fibers passing therebetween, means for delivering liquid impregnated fibers into and from the applicator and into and through an elongate heating tube under compression to react or fix the liquid dye or chemical in the fibers, and means for collecting the fibers after dye or chemical reaction; the improvement therewith wherein said means for continously delivering the fibers to the nip roller means includes fiber condenser means located in the path of movement of the fibers to the nip roller means for forming the loose staple length fibers into a cohesive web of fibers by pneumatic pressure differential deposition onto a moving surface, and wherein said cohesive web has sufficient cohesive integrity such that said cohesive web is passed into and through the liquid on the driven nip roller means and the nip portion of the driven nip roller means without parting, and means for separating the web into discrete smaller fiber portions while continously delivering the same from the driven nip roller means into the elongate heating tube.

2. Apparatus as defined in claim 1 wherein said condenser means includes a housing containing a rotating perforated drum, means for producing pressure differential across the drum surface whereabout fibers delivered to the housing of the condenser means are collected on the drum surface in a generally cohesive web, and means for continuously removing a portion of the web from the drum surface and delivering the same in longitudinal continuous form to said dye applicator.

3. Apparatus as defined in claim 2 wherein said condenser means includes fan means for pneumatically conveying loose fibers into said fiber condenser means housing and onto the surface of the rotating drum for collection into said cohesive web form.

4. Apparatus as defined in claim 1 wherein said means for continuously delivering the fibers into the applicator includes a downwardly inclined chute positioned between said condenser means and the nip of the driven nip roller means for gravitationally delivering the web into the nip portion of the driven nip roller means for contact with the liquid and the nip of the driven nip roller means.

5. Apparatus as defined in claim 4 wherein said means for continuously delivering the fibers into the applicator further includes roller means positioned between said fiber condenser means and said downwardly inclined chute for applying a pressure to the thickness of the web during its movement to the driven nip roller means.

6. A method for the treatment of continously moving textile fibrous materials with a liquid dye or chemical wherein the materials are continously delivered in staple length textile fiber form into a liquid dye or chemical applicator having driven nip roller means for impregnating and expressing the liquid from the fibers passing therebetween, the fibers are subsequently delivered continously from the applicator into and through an elongate heating tube under compression to react or fix the liquid dye or chemical in the fibers, and the fibers are subsequently collected; the improvement therewith including the step of forming the fibers into a cohesive web by pneumatic pressure differential deposition onto a moving surface, and wherein said cohesive web has cohesive integrity such that said cohesive web is passed into and through the nip roller means without parting, and thereafter separating the web into discrete, smaller fiber portions before delivery into the elongate heating tube.

* * * * *